US006329614B1

(12) United States Patent
Miyashita

(10) Patent No.: US 6,329,614 B1
(45) Date of Patent: Dec. 11, 2001

(54) MULTI-DIRECTIONAL SWITCH HAVING A PLURALITY OF MANUAL SWITCHES

(75) Inventor: Isao Miyashita, Fujiyoshida (JP)

(73) Assignee: Citizen Electronics Co., Ltd., Fujiyoshida (JP)

( * ) Notice: Subject to any disclaimer, the term of this patent is extended or adjusted under 35 U.S.C. 154(b) by 0 days.

(21) Appl. No.: 09/588,659

(22) Filed: Jun. 6, 2000

(30) Foreign Application Priority Data

Jun. 8, 1999 (JP) ..... 11-161736

(51) Int. Cl.[7] ..... H01H 25/04
(52) U.S. Cl. ..... 200/5 R; 200/6 A
(58) Field of Search ..... 200/4, 5 R, 6 R, 200/6 A, 517, 17 R, 18

(56) References Cited

U.S. PATENT DOCUMENTS 4,408,103 * 10/1983 Smith, III ..... 200/6 A
4,493,219 * 1/1985 Sharp et al. ..... 73/862.05
4,614,847 * 9/1986 Sasao ..... 200/6 A
4,992,631 * 2/1991 Gee ..... 200/5 A
5,430,262 * 7/1995 Matsui et al. ..... 200/5 A
5,621,196 * 4/1997 Nishijima et al. ..... 200/6 A
5,952,628 * 9/1999 Sato et al. ..... 200/4
6,080,941 * 6/2000 Yokobori ..... 200/6 A

FOREIGN PATENT DOCUMENTS 10188738 7/1998 (JP) .

* cited by examiner

*Primary Examiner*—Michael Friedhofer
(74) *Attorney, Agent, or Firm*—Birch, Stewart, Kolasch & Birch, LLP

(57) ABSTRACT

A plurality of fixed contacts and a movable contact are provided on a substrate so that opposite contacts form a unit switch. A holding plate having a spherical overhang holding wall is mounted on the substrate, and an operating plunger having a plurality of radially extending arms is slidably mounted in a hole formed in the holding plate, and rotatably held in the spherical overhang holding wall. A plurality of projections are formed on the underside of the plunger, each of the projections is provided corresponding to the movable contact.

8 Claims, 6 Drawing Sheets

MULTI-DIRECTIONAL SWITCH HAVING A PLURALITY OF MANUAL SWITCHES

BACKGROUND OF THE INVENTION

The present invention relates to a multi-directional switch comprising a plurality of manual switches and used in electronic devices such as a portable telephone, video camera, car radio and others.

The multi-directional switch comprises a plurality of fixed contacts circularly arranged in a housing, and an operating plunger tiltably provided in the housing and having a plurality of branches, each having a movable contact which can be contacted with a corresponding fixed contact in the housing by manipulating the operating plunger, thereby producing a specific signal.

FIG. 12 is a sectional side view of a multi-directional switch disclosed in the Japanese Patent Application Laid open 10-188738. There is provided on the bottom of a housing 1 a central fixed contact 2, four peripheral fixed contacts 4, a central movable contact 6 corresponding to the central fixed contact 2, four peripheral movable contacts 7, each provided for a corresponding fixed contact 4, and a circular common fixed contact 3. The central movable contact 6 has a circular tray shape. The peripheral movable contact 7 has a central arcuated yieldable bridge 7*a*.

A peripheral portion of the central movable contact 6 contacts with the common fixed contact 3 and the central portion of the contact 6 is not contacted with the central fixed contact 2. An inner portion of the peripheral movable contact 7 contacts with the common fixed contact 3, and the bridge 7*a* is not contacted with the peripheral fixed contact 4.

A first stem 8 and a second stem 10 as an operating plunger are mounted on the movable contacts 6 and 7. The first stem 8 comprises a cylindrical portion 8*a* and a skirt portion 8*b* having a spherical peripheral wall. The skirt portion 8*b* has four projections 8*c* on the underside thereof, each contacts with a corresponding bridge 7*a* of the movable contact 7. The first stem 8 is tiltably held by wall of a hole of a cover 11 at the spherical wall thereof.

The second stem 10 has a quadratic prism shape and is vertically slidably mounted in a guide hole 9 of the first stem 8, and prevented from removing from the hole 9 by a flange 10*a*.

The switches are operated by manipulating the second stem 10. For example, when the second stem 10 is tilted to the left, the first stem 8 is also tilted to the left, so that the projection 8*c* pushes the bridge 7*a* to yield it, thereby contacting the bridge to the fixed contact 4. Thus, the contact 4 is electrically connected to the common contact 3 by the bridge 7*a*. Other switches are similarly operated.

When the second stem 10 is depressed, a projection 10*b* pushes the central movable contact 6 to yield it so that the movable contact 6 contacts with the fixed contact 2.

In the above described conventional multi-directional switch, the first stem 8 comprises the cylindrical portion 8*a* and the skirt portion 8*b*, and the second stem 10 is upwardly projected from the first stem 8. Consequently, the height of the switch becomes large, and hence it is difficult to reduce the thickness and the size of the switch.

SUMMARY OF THE INVENTION

An object of the present invention is to provide a multi-directional switch which may be reduced in thickness and size thereof.

Another object of the invention is to provide a multi-directional switch which is simple in construction and reliable in operation.

According to the present invention, there is provided a multi-directional manual switch comprising a substrate having a plurality of fixed contacts and a movable contact provided above each of the fixed contacts so that opposite contacts form a unit switch, a holding plate having a spherical overhang holding wall andmountedon the substrate, an operating plunger having a plurality of radially extending arms, and slidably mounted in a hole formed in the holding plate, and rotatably held in the spherical overhang holding wall, and a plurality of projections formed on the underside of the plunger, each of the projections being provided corresponding to the movable contact.

The unit switches comprise a central unit switch and a plurality of peripheral unit switches, the projections comprise a central projection and peripheral projections corresponding to the unit switches, the operating plunger is rotatably and axially slidably mounted in the spherical overhang holding wall, and a gap is formed between each of the peripheral projections and the corresponding movable contact in the condition that the central projection contacts with the corresponding movable contact.

The movable contact has an inverted tray shape, and the fixed contact of the unit switch comprises a central fixed contact and a plurality of peripheral fixed contacts.

These and other objects and features of the present invention will become more apparent from the following detailed description with reference to the accompanying drawings.

DETAILED DESCRIPTION OF THE PREFERRED EMBODIMENT

Figure 1:
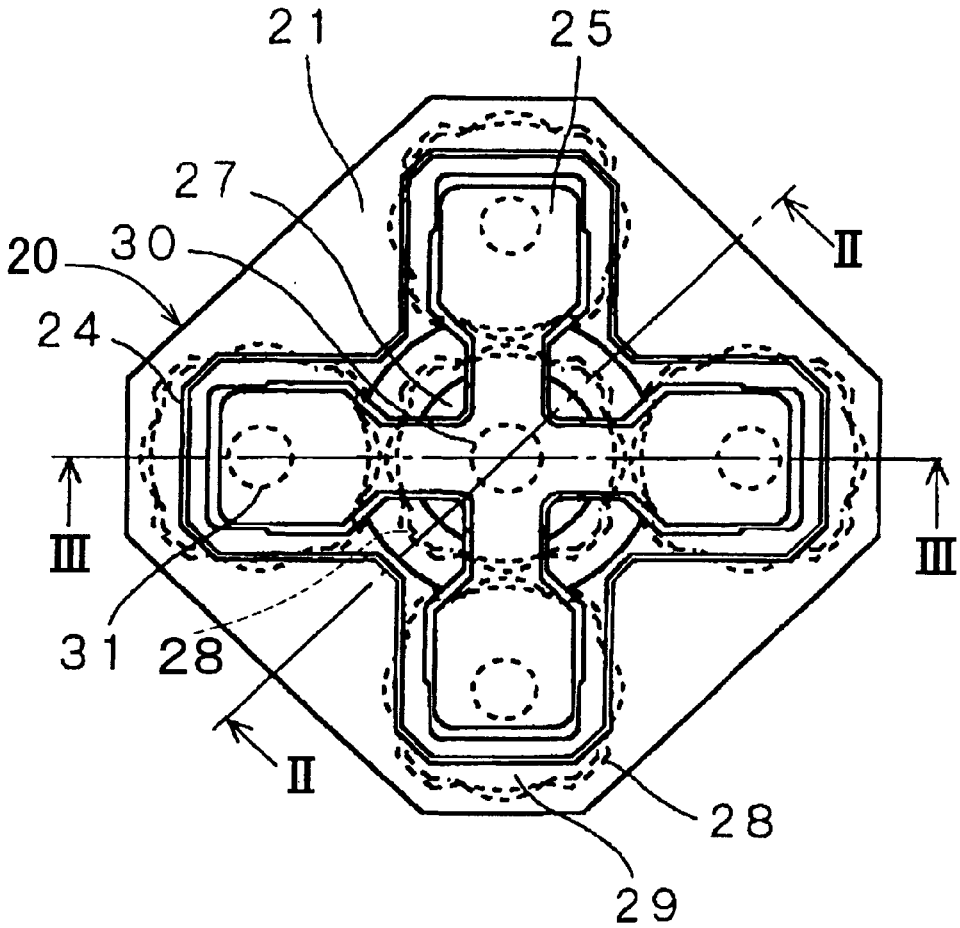
FIG. 1 is a plan view showing a multi-directional switch according to the present invention.
Figure 3:
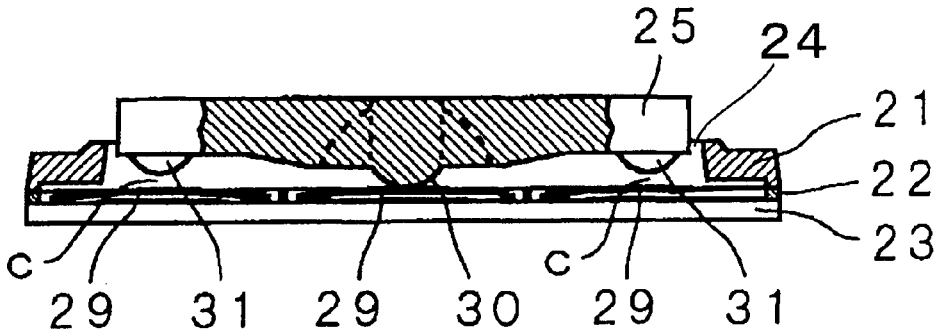
FIG. 3 is a sectional view taken along a line III—III of FIG. 1.
Figure 2:
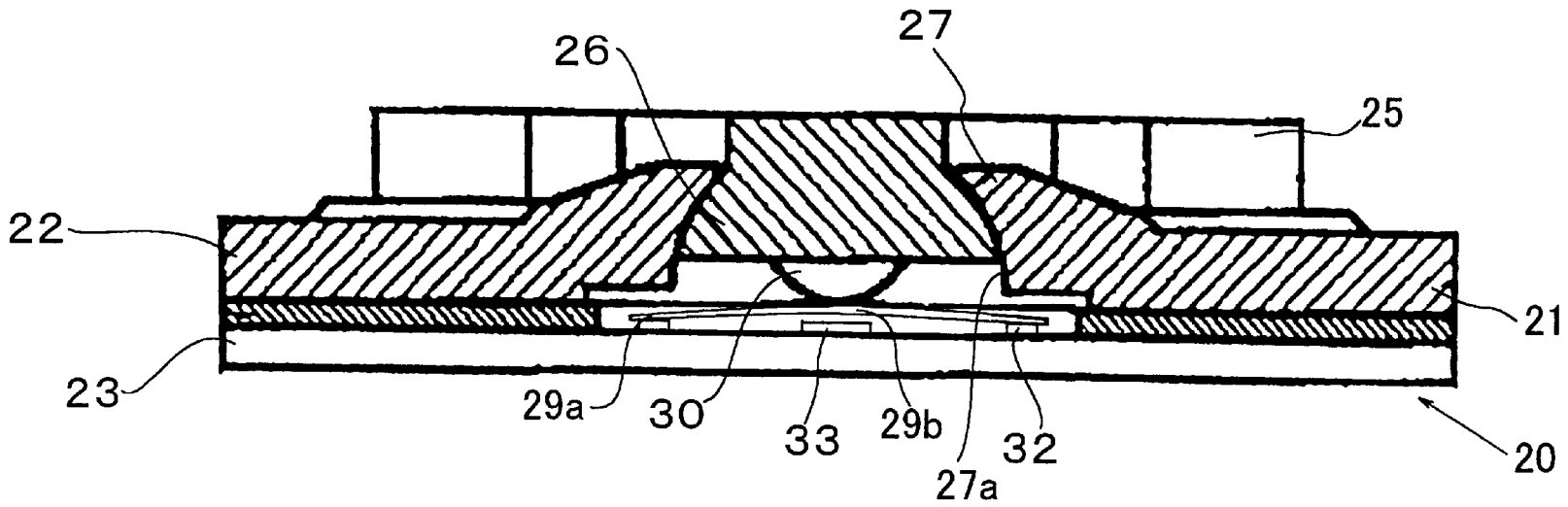
FIG. 2 is a sectional view taken along a line II—II of FIG. 1.

Referring to FIGS. 1 through 3, the multi-directional switch of the present invention comprises a flat body 20 and a flat operating plunger 25.

The body 20 is formed by laminating a plastic holding plate 21, a plastic spacer 22 and a printed circuit board 23. As shown in FIG. 1, the body 20 has a square shape. The holding plate 21 has a hole 24 in a shape of a cross along the diagonal of the square. Each branch of the hole has a narrow base portion and a wide end portion.

Figure 4:
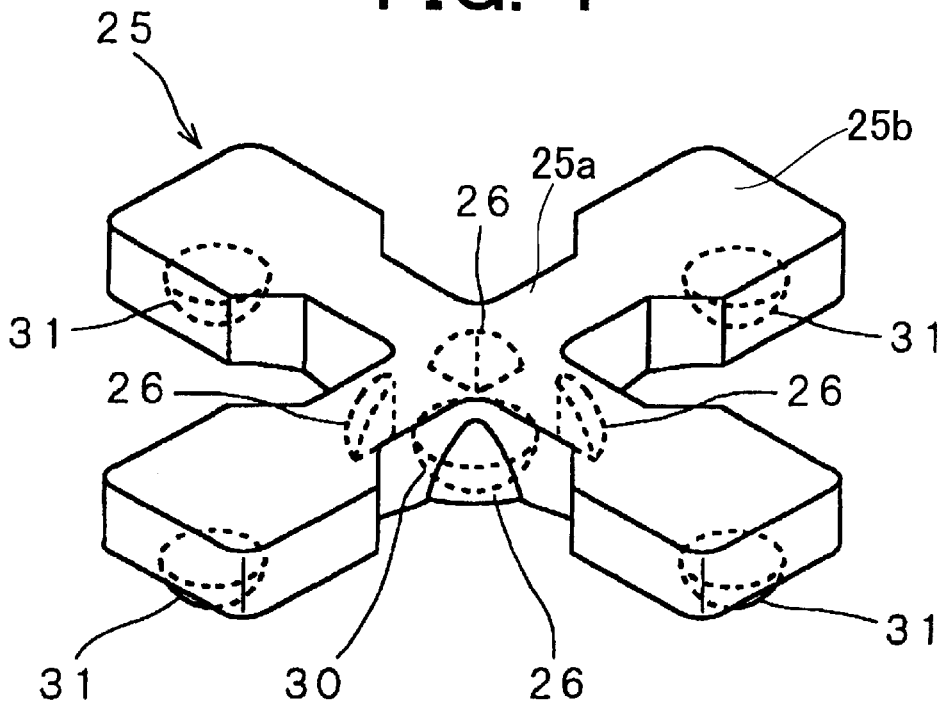
FIG. 4 is a perspective view of a plunger.

The operating plunger 25 is slidably mounted in the hole 24. As shown in FIG. 4, each arm of the operating plunger 25 comprises a narrow base portion 25*a* and a manipulating end portion 25*b*. The gap between the manipulating end portion 25*b* and the wall of the hole 24 is small so that the arm may not pivot in the hole.

Referring to FIGS. 1 and 2, the holding plate 21 has four supporting portions 27 between adjacent holes 24, each having a spherical overhand holding wall 27*a*. The operating plunger 25 has four spherical projections 26 between adjacent base portions as shown in FIG. 4. The spherical projections 26 are rotatably supported by the holding walls 27*a* and prevented from upwardly removing. As shown in FIG. 4, a part of the spherical projection 26 is positioned within the thickness of the operating plunger. Therefore, the height of the switch can be reduced.

Referring to FIG. 1, five apertures 28 are formed in the spacer 22 at a central portion and at four portions corresponding to manipulating end portions 25*b* of the operating plunger 25.

Figure 5:
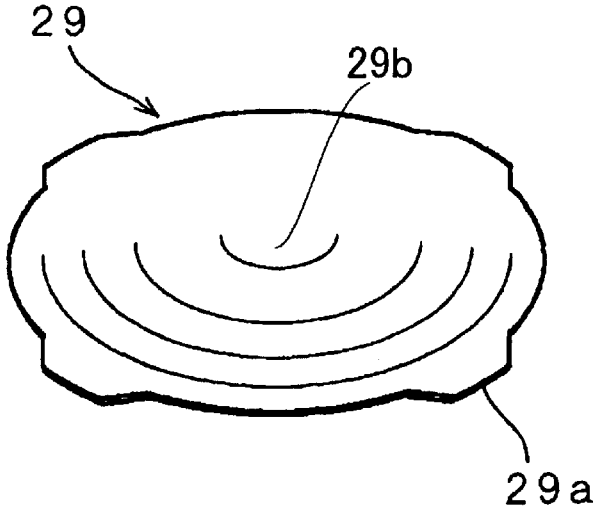
FIG. 5 is a perspective view of a movable contact.
Figure 6:
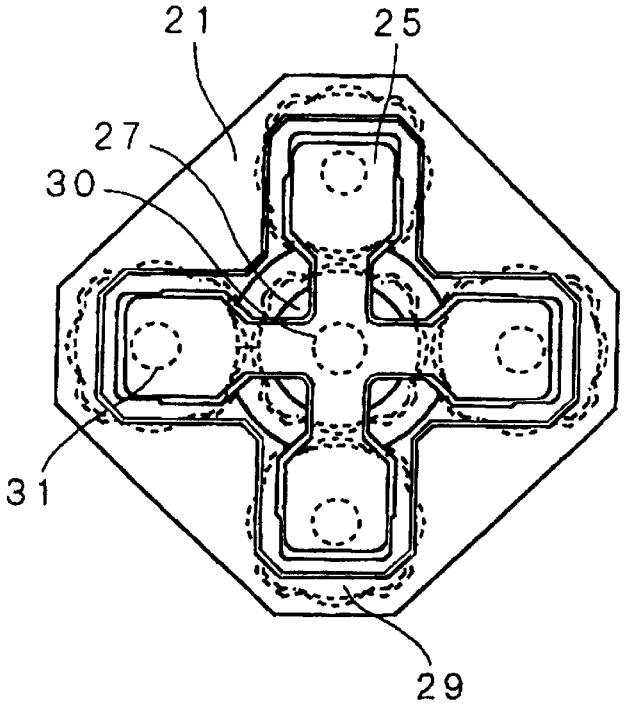
FIGS. 6 to 8 are similar drawings to FIGS. 1 to 3 for explaining one of operations of the switch.

In each aperture 28, a circular movable contact 29 is disposed and positioned therein. As shown in FIGS. 2 and 5, the movable contact 29 has an inverted tray shape having a spherical central portion 29*b*, and four feet 29*a*. Each foot 29*a* contacts with a peripheral fixed contact 32 provided on the printed circuit board 23. The central portion 29*b* is positioned above a central fixed contact 33 on the circuit board 23.

Referring to FIG. 3, on the underside of a central portion of the operating plunger 25, a spherical central projection 30 is formed corresponding to the central fixed contact 33, and a spherical peripheral projection 31 is formed on the underside of each manipulating end portion 25*b* corresponding to the peripheral fixed contact 32. Although the central projection 30 contacts with the central movable contact 29, the peripheral projections 31 are not contacted with the peripheral movable contacts 29, thereby providing a gap C therebetween.

A protective plastic film (not shown) is provided between the holding plate 21 and the spacer 22 so as to protect the circuit on board 23 and the movable contacts 29 from water and dust.

Figure 7:
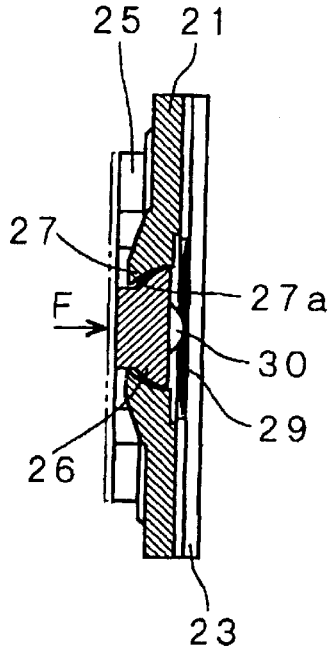
Figure 8:
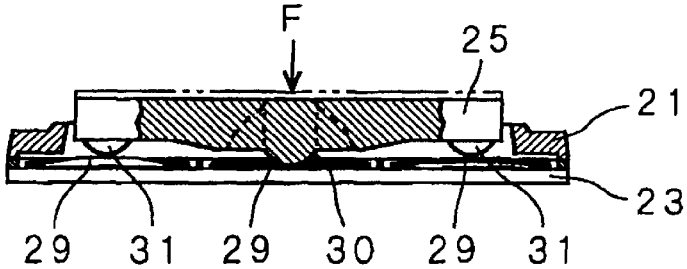
Figure 9:
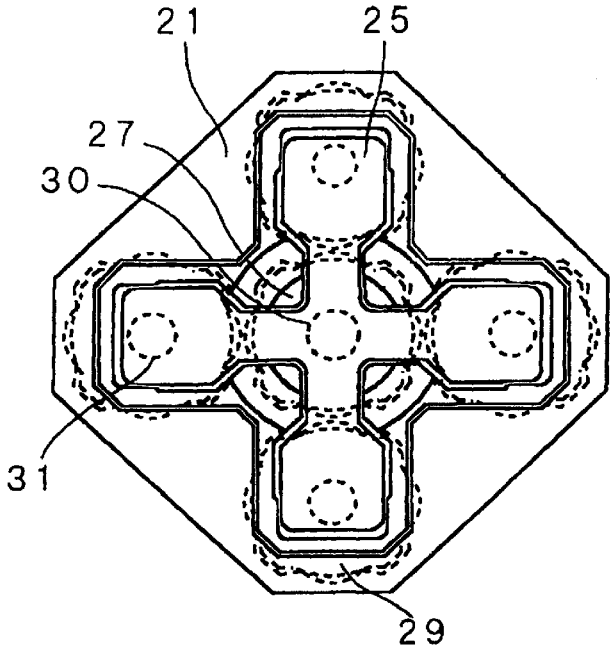
FIGS. 9 to 11 are similar drawings to FIGS. 1 to 3 for explaining another operation of the switch.

In operation, referring to FIGS. 7 and 8, when a central portion of the operating plunger 25 is depressed by a finger of an operator as shown by an arrow F, the operating plunger is lowered, keeping a horizontal position. Consequently the central movable contact 29 is yielded to be contacted with the central fixed contact 33 on the circuit board 23. Thus the peripheral fixed contacts 32 are connected to the central fixed contact 33 by the movable contact 29, so that the central switch is closed. At that time, the peripheral projections 31 do not deform the peripheral movable contacts 29 as shown in FIG. 8. This is caused by the gap C in FIG. 3. Namely, the gap C is provided to have a sufficient height so as not to deform the movable contact 29. Even if the operating plunger 25 is slightly tilted, the peripheral switch is not closed. More particularly, the component of the force F at the end portion 25*b* of the arm is very small compared with the force F at the central portion because of a large lever ratio. Furthermore, since the arm is a cantilever, the arm is flexed when the arm contacts with the fixed contact. Because of these conditions, the peripheral switch is not closed, as long as the arm is not tilted at an extremely large angle.

Figure 10:
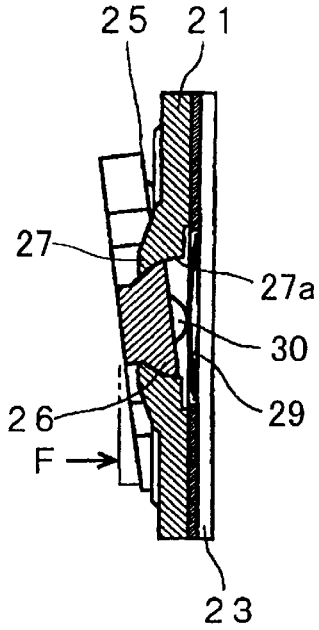
Figure 11:
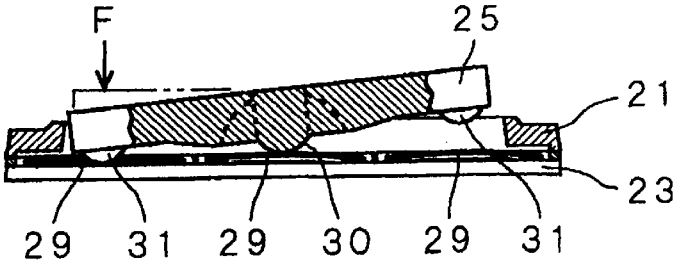
Figure 12:
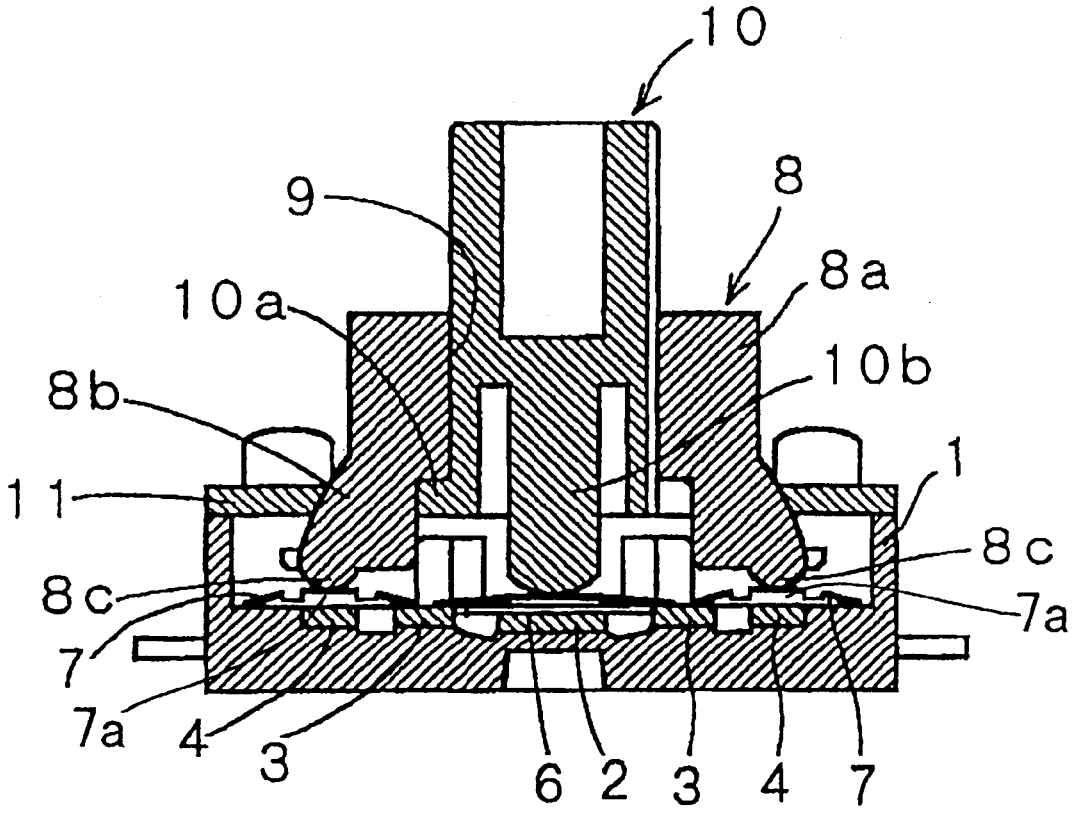
FIG. 12 PRIOR ART
FIG. 12 is a sectional view of a conventional multi-directional switch.

Referring to FIGS. 10 and 11, when one of the manipulating end portions 25*b* of the operating plunger 25 is depressed, the spherical peripheral projection 31 deforms the movable contact 29, so that the movable contact 29 is contacted with the central fixed contact 32. Thus, the peripheral switch is closed.

At that time, the operating plunger 25 rotates about a center of the sphere by the spherical overhang holding wall 27*a*, so that the projection 30 does not deform the movable contact 29 as shown in FIG. 10. Furthermore, other peripheral end portions 25*b* do not deform the corresponding movable contacts 29 since component of the force of each end portion 25*b* is small because of the large lever ratio as described above.

In accordance with the present invention, since the multi-directional switch is composed by a flat body and a flat operating plunger, the thickness of the switch can be reduced and the construction is simple. In addition, since the plunger is mounted in a hole of the body, the thickness is further reduced.

While the invention has been described in conjunction with preferred specific embodiment thereof, it will be understood that this description is intended to illustrate and not limit the scope of the invention, which is defined by the following claims.

What is claimed is:

1. A multi-directional manual switch comprising: a substrate having a plurality of fixed contacts and a movable contact provided above each of the fixed contacts so that opposite. contacts form a plurality of unit switches;

each of the fixed contacts comprising a pair of fixed contacts, and each of the movable contacts having a sectional shape of an upwardly expanded shape and lower ends of the movable contact being contacted with the fixed contacts; a flat holding plate having a spherical overhang holding wall and mounted on the substrate;

an operating plunger comprising a flat plate and having a plurality of radially extending arms, and slidably mounted in a hole formed in the holding plate, and rotatably held in the spherical overhang holding wall at spherical projections formed at a central portion thereof; and a plurality of projections formed on an underside of the plunger, each of the projections being provided corresponding to each of the movable contacts.

2. The multi-directional manual switch according to claim 1 wherein the unit switches comprise a central unit switch and a plurality of peripheral unit switches, the projections comprise a central projection and peripheral projections corresponding to the unit switches, the operating plunger is rotatably and axially slidably mounted in the spherical overhang holding wall, and a gap is formed between each of the peripheral projections and the corresponding movable contact in a condition that the central projection contacts with the corresponding movable contact.

3. The multi-directional manual switch according to claim 1 wherein the movable contact has an inverted tray shape, and each of the fixed contacts of the unit switch comprises a central fixed contact and a plurality of peripheral fixed contacts.

4. The multi-directional manual switch according to claim 3 wherein each of the movable contacts has feet contacted with the peripheral fixed contacts.

5. A multi-directional manual switch comprising:

a substrate;

a plurality of switches disposed on the substrate, each of the switches comprising a plurality of fixed contacts and a movable contact, each of the movable contacts having an upwardly expanded shape and a lower end thereof in contact with at least one of the fixed contacts;

a flat holding plate mounted on the substrate, the holding plate having an overhang holding wall with a spherical surface;

an operating plunger comprising a flat plate having a central portion, a plurality of arms extending radially from the central portion and a plurality of spherical projections on the central portion, the plunger being slidably mounted in a hole formed in the holding plate, and the spherical projections engaging the spherical surface of the overhang holding wall, whereby the plunger is rotatably held in the overhang holding wall; and a plurality of projections formed on an underside of the plunger, each of the projections being disposed adjacent to a corresponding movable contact.

6. The multi-directional manual switch according to claim 5 wherein:

the switches comprise a central switch and a plurality of peripheral switches;

the projections comprise a central projection and peripheral projections corresponding to the switches; and when no actuating force is applied to the plunger, (1) a gap is formed between each of the peripheral projections and the corresponding movable contact and (2) the central projection contacts the corresponding movable contact.

7. The multi-directional manual switch according to claim 5 wherein the movable contact has an inverted tray shape, and the fixed contacts of each switch comprise a central fixed contact and a plurality of peripheral fixed contacts.

8. The multi-directional manual switch according to claim 7 wherein each of the movable contacts has feet in contact with the peripheral fixed contacts.

* * * * *